United States Patent [19]

Wynne

[11] 3,962,528

[45] June 8, 1976

[54] FURNACE SKEWBACK SUPPORT WITH BUCKSTAY PIVOT

[75] Inventor: Peter J. Wynne, Pittsburgh, Pa.

[73] Assignee: Lectromelt Corporation, Pittsburgh, Pa.

[22] Filed: Feb. 7, 1975

[21] Appl. No.: 547,774

[52] U.S. Cl. ..... 13/35

[51] Int. Cl.[2] ..... F27D 1/14

[58] Field of Search ..... 13/9, 35

[56] References Cited

UNITED STATES PATENTS

| | | | |
|---|---|---|---|
| 2,116,202 | 5/1938 | Honegger | 13/9 |
| 2,200,372 | 5/1940 | Linder | 13/9 UX |
| 2,263,848 | 11/1941 | Keaney | 13/35 X |

*Primary Examiner*—R. N. Envall, Jr.
*Attorney, Agent, or Firm*—Fred Wiviott

[57] ABSTRACT

A refractory lined electric arc furnace has a hearth, sidewalls and an arched roof. Skewback refractories are disposed between the roof and the sidewalls and are pivotally coupled to vertical support posts which bear against the sidewalls so that the skewbacks may change their angular relation to the sidewalls without inducing undue stresses in the roof as the lower ends of the side walls move inwardly and outwardly as the result of unequal expansion of the hearth relative to the roof.

20 Claims, 4 Drawing Figures

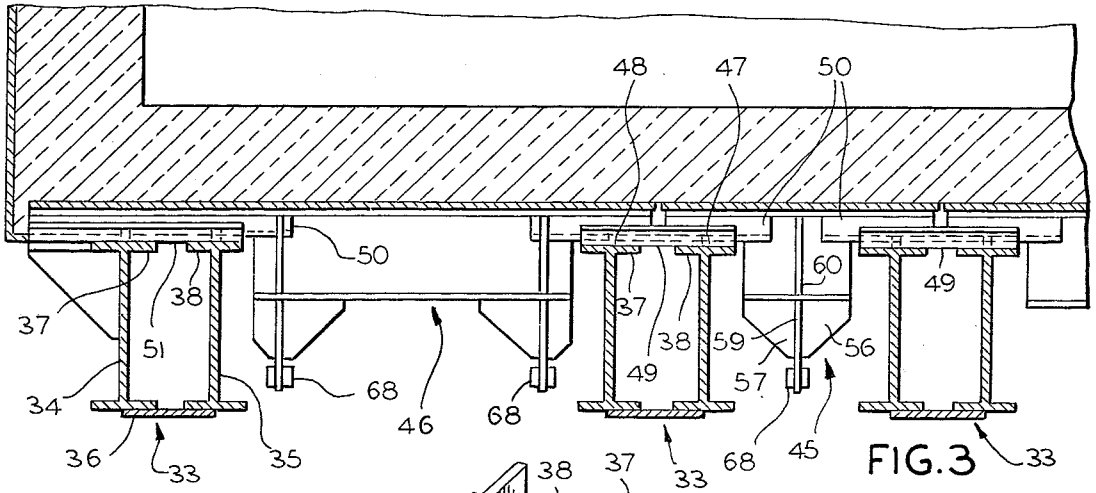
FIG. 3
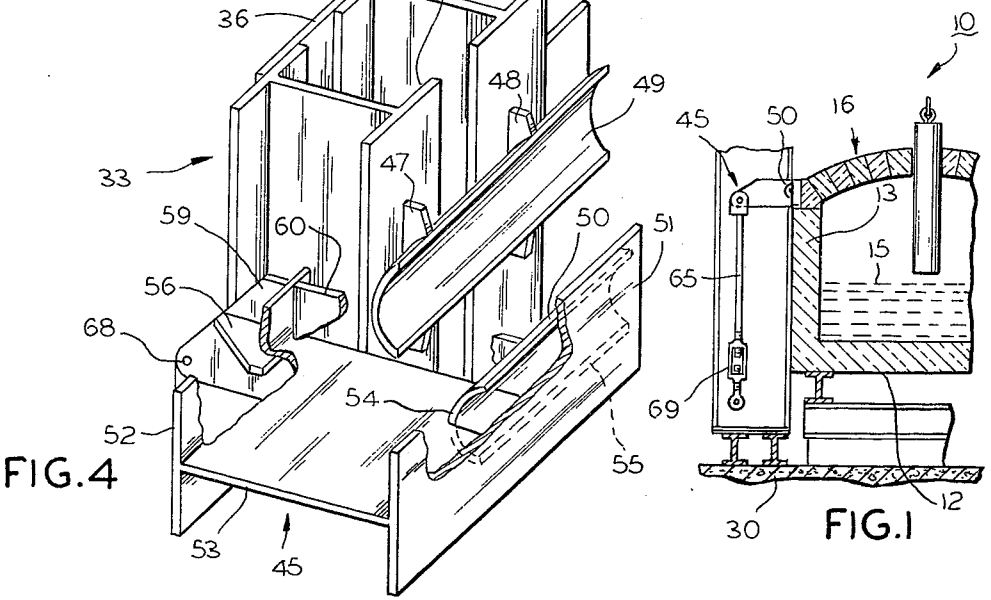
FIG. 1
FIG. 4
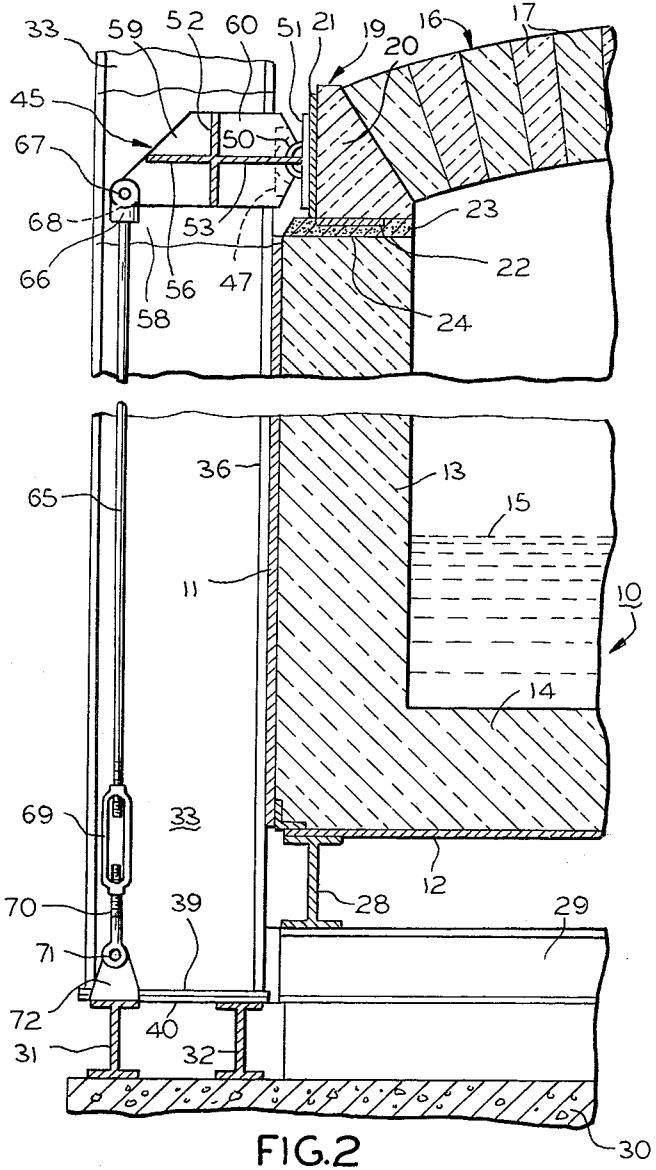
FIG. 2

FURNACE SKEWBACK SUPPORT WITH BUCKSTAY PIVOT

BACKGROUND OF THE INVENTION

This invention relates to means for supporting an arched roof of a furnace. A rectangular electric arc furnace is typical of furnaces to which the invention applies.

Conventional non-tilting electric arc furnaces comprise an open topped metal shell which has internal walls and a bottom lined with refractory material. The roof of such furnaces is usually composed of refractory bricks formed in an arch. The ends of the arch bear against laterally adjacent skewback bricks which are supported on the top of the furnace walls. As is known, the arch tends to sag and force the skewbacks outwardly but they are restrained against sliding laterally in which case compressive forces are developed in the arch which prevent it from collapsing.

Customarily, the refractory lined furnace shell rests on a foundation which also supports rows of verticle buckstays or columns from which the roof is suspended.

A problem with this prior arrangement is that the body of the furnace expands laterally more at its bottom than at its top since the bottom region is hotter because of it being occupied by molten metal. There is also hydrostatic stress developed by the molten metal which tends to bulge the furnace outwardly near the bottom. The lateral forces of expansion are transferred from the furnace shell to the buckstays which tend to rotate, thus causing high stress to be developed between the skewbacks and the arched roof. It is well known that this may damage the roof and skewbacks.

SUMMARY OF THE INVENTION

A general object of this invention is to provide for supporting the skewbacks and the roof in such manner that undue stresses are not developed by uneven expansion of the furnace.

A further object of this invention is to provide means for permitting the buckstays to pivot relative to the skewbacks which they restrain to thereby alleviate or avoid moments of force which would cause undue stress.

The invention is generally characterized by a refractory lined furnace shell supported on foundation beams. Rows of buckstays on opposite sides of the furnace are juxtaposed with the shell comprising the wall of the furnace. The buckstays are supported at their lower ends in such manner that they can yield outwardly when the bottom portion of the furnace expands laterally. A plurality of beam members which restrain the skewbacks against laterally outward motion and are essentially levers are provided with bearing members of a first type. Each of the buckstays has a complementary bearing member of a second type mounted on it so that the buckstays may pivot on the first bearing members. The beam members or levers are restrained against rotation with tie rods that are anchored independently of the buckstays.

Achievement of the foregoing and other more specific objects of the invention and an illustrative embodiment thereof will now be described in greater detail in reference to the drawings.

DESCRIPTION OF THE DRAWINGS

FIG. 1 is a side elevational view showing an electric arc furnace in which the invention may be incorporated;

FIG. 2 is a fragmentary transverse section through a part of the furnace illustrated in FIG. 1;

FIG. 3 is a partial plan view of the furnace of FIG. 1 with the skewbacks omitted; and FIG. 4 is an exploded view of the skewback support assembly.

DESCRIPTION OF A PREFERRED EMBODIMENT

FIG. 1 shows an electric arc furnace 10 having a metal shell which includes a sidewall portion 11 and a bottom portion 12. The interior of the side wall shell is lined with refractory material 13 as is the hearth or bottom 14. During operation, the furnace 10 may contain a quantity of molten metal. Although the furnace 10 is not shown in plan view, it will be appreciated that it may have any convenient shape which is well known in the art. For example, vessel 10 may be oblong and have a number of electrodes 15 arranged in a parallel array or the vessel may be generally circular in plan view and have one or more electrodes 15 extending through the arched roof 16. The present description is made with respect to an oblong furnace 10 which is viewed at one end in FIGS. 1 and 2.

The furnace has an arched roof 16 which may be comprised of refractory bricks 17 which may have any convenient shape and which are arranged in a suitable curved form, in accordance with practice well known to those who are skilled in the furnace arts. The ends of arched roof 16 are supported by a row of skewback bricks 19 of refractory material. The skewbacks 19 have beveled surfaces 20 which interface with opposite ends of the roof. The skewbacks are supported in a generally L-shaped shelf bracket which has an upstanding portion 21 and a horizontal portion 22. The shelf bracket rests in grouting 23 or insulating material which is deposited on the upper end surface 24 of the furnace walls 13. The wall, on the other side of the furnace 10 has a similar row of skewbacks on its top.

Although the new skewback support apparatus, to be described in detail later, is applicable to arched roofed furnaces with round or long rectangular bodies irrespective of how the furnace is heated, the apparatus is illustrated in a rectangular electric furnace having electrodes which may extend into molten material 15 for resistance heating or there may be a gap between the electrode tips and the molten material as in an electric arc furnace.

The bottom shell plate 12 of the furnace is supported on a number of parallel longitudinally extending I-beams 28, one of which is shown in FIG. 1. Beams 28 are supported on transverse beams 29 which are on a concrete pier 30.

Extending longitudinally on both sides of the furnace are pairs of I-beams such as 31 and 32 on which a row of spaced apart verticle support columns or buckstays 33 are supported. In this example, as can be seen in the leftmost region of FIG. 3, a typical buckstay 33 comprises two I-beams 34 and 35 which have their outer flanges joined with a plate 36 that is welded to each of the I-beams. The inside flanges 37 and 38 of the I-beams comprising the buckstays are in contact with the metal sidewall 11 of the furnace over substantially the length of the buckstays when the furnace is cold and not expanded.

As can be seen in FIG. 2, the lower ends of the buckstays have a foot plate 39 welded to them. The foot plates bear on bed plates 40 which span between I-beams 31 and 32 and are welded to them. It will be evident that the lower ends of the buckstays 33 are free to yield laterally outwardly of the furnace body under the influence of expansion by the furnace body. During a furnace processing operation, the hearth 14 will expand outwardly thereby tending to pivot the sidewalls about their upper ends which tends to alter the angular relationship between the skewbacks 19 and arched roof 16 causing a thrust load to be applied to the upper ends of the bricks 17. In accordance with the invention, means are provided so that this stress loading will not be induced in the bricks of the roof 18.

The new skewback support assembly will now be described in greater detail. The skewbacks 19 are constrained by rocking beam members or levers of two types which are marked 45 and 46, respectively, in FIGS. 1 and 2. A rocking beam member 45 and its relationship with the buckstays is typified in the exploded view of the assembly of FIG. 4 to which attention is now invited. The rocking beam member 45 comprises an I-beam which has said inside flange 51, an outside flange 52 and an integral web 53. Welded onto the inside flanges 37 and 38 of the buckstays are a pair of saddles 47 and 48. A concave bearing member 49, constituting an elongated segment of a cylinder, is welded to saddles 47 and 48 with the axis of the cylinder substantially horizontal. A complementarily shaped convex bearing segment 50 constitutes another bearing member welded to the back of a flange 51 on rocking beam member 45. Bearing segment 50 has a slot 54 which receives an edge of web 53 and to which it may be suitably joined, such as by welding to web 53 in the vicinity of slot 54. The edges 55 of segment 50 are preferably welded along their entire lengths to the back of flange 51. The outside convexly curved surface of bearing member 50 has substantially the same radius as the inside concavely curved surface of bearing segment 49. In FIGS. 1 and 2 where the parts are shown in their normal relationship, it will be evident that convex bearing member 50 on beam member 53 nests in concave bearing segment 49 which is supported on buckstays 33.

In FIGS. 2 and 3 it is evident that rocking beam members such as 45 and 46 may have horizontally disposed webs, stiffener webs 56 and 57 and vertically extending webs 58, 59 and 60. As can be seen in FIG. 3, a typical rocking beam member 45 has two bearing segments 50 extending in opposite longitudinal directions from it and these nest in adjacent bearing segments 49 which are fastened to buckstays 33. Thus, members 45 and 46 are situated between adjacent buckstays 33.

It should be evident from the description thus far that complementary bearing segments 50 and 49 will restrain skewbacks 19 against outward movement due to internal compressive stress in the arch 18 and that the segments may carry some of the gravity load of the roof arch 16. The weight of the roof 16 and the skewbacks 19 is further distributed over the surface of the grout material 23 which intervenes between skewbacks 19 and the upper end 24 of furnace wall 13. To obtain proper roof support, members 45 are preferably adjusted to a predetermined angle. This is achieved by means of several tie rods 65 which each have an upper clevis 66 for pivotally connecting it to lever member 45 by means of a pin 67. The spaced apart sides of clevis 66 engage bosses 68 between them as can be seen on member 45 in FIG. 3. Beam members 45 have one tie rod 65 attached and beam members 46 have two. Tie rod 65 has a turnbuckle 69 in it and a threaded eye-bolt 70 of the turnbuckle is pivotally connected with a pin 71 to a bracket 72. Bracket 72 is fixedly attached such as by welding to one of the I-beams 31 which supports the buckstay bed plate 40. Hence, as explained earlier, buckstay 33 is shiftable slightly on bed plate 40 but bracket 72, being welded to beam 31, is not shiftable laterally. In effect, lever members such as 45 and 46 are held in a predetermined angular attitude by turnbuckle rod 65.

However, note that the buckstays 33 are, in reality, pivotally coupled to lever members 45 and 46 by virtue of bearing segments 49 and 50 being engaged. Thus, the buckstays cannot impose a bending moment on the skewbacks 19 which moment would be induced in arched furnace roof 16 when the buckstays are influenced by substantial laterial expansion of the hearth 14.

It is desirable to coat the interfacing surfaces of bearing segments 49 and 50 with graphite containing grease to minimize wear incident to the rocking action that occurs when furnace temperature rises and falls.

Skewback support beam 46 is constructed similarly to lever member 45 which has been described in detail except that beam member 46 has two sets of bosses 68 for attachment of turnbuckle rods 65. Each such rod, is of course, fastened at its lower end through the buckstay supporting beams 31 adjacent the buckstays.

Although an illustrative embodiment of the new buckstay pivot joint assembly and skewback support has been described in considerable detail, such description is to be considered illustrative rather than limiting, for the invention may be variously embodied and is to be limited only by interpretation of the claims which follow.

I claim:

1. A refractory lined furnace comprising:

a sidewall and a hearth, skewback refractory means disposed along the top of said sidewall, an arched roof constructed and arranged for bearing against said skewback refractory means to obtain support for said roof, support means adjacent said skewback refractory means and said sidewall, and restraining means engaging said skewback refractory means and including bearing means for pivotally connecting said restraining means to said support means and for transfering outwardly directed forces from said skewback refractory means to said support means, said bearing means permitting relative pivotal movement between said restraining means and said support means without inducing forces in said skewback refractory means.

2. The invention set forth in claim 1 wherein said bearing means includes a first bearing member mounted on said support means and a second bearing member mounted on said restraining means and pivotally engaging said first bearing member.

3. The invention set forth in claim 2 and including means for establishing the angular orientation of said restraining means.

4. The furnace set forth in claim 3 wherein said means for establishing said angular position of said restraining means comprising tie rod means having an end connected to said restraining means and another end anchored independently of said furnace and of said support means.

5. The invention of claim 4 wherein said tie rod means includes turnbuckle means for adjusting the length of said tie rod means.

6. A refractory lined furnace comprising:

a. a sidewall and a hearth, b. skewback refractory means disposed along the top of said sidewall, c. an arched roof constructed and arranged for bearing against said skewback means to obtain support for said roof, d. support means adjacent said skewback means and said sidewall, e. coupling means including means for restraining said skewback means in opposition to forces produced thereon by said roof and pivotal coupling means for pivotally connecting said coupling means to said support means, said pivotal coupling means comprising a first concave bearing member fixed on one of said couplings and support means and a second convex bearing member fixed on the other of said coupling and support means, said members being in complementary contact relation with each other and relatively rotatable.

7. The invention of claim 6 wherein said bearing members comprise segments of a hollow cylinder.

8. An electric arc furnace comprising:

a. a refractory lined furnace body defining a side wall and a hearth and having a top opening.

b. means for supporting said furnace body, c. skewback refractory means disposed along the top of said wall, said skewback refractory means having beveled surfaces, d. an arched refractory roof having an edge for engaging said beveled surfaces to support said roof, e. a plurality of longitudinally spaced apart support columns adjacent the sides of said furnace, f. means for supporting said support columns adjacent said furnace and separately of said furnace supporting means and said furnace body, g. coupling means and means for mounting said coupling means for pivotal movement on said support columns, said coupling means having an arm on one side of said pivotal mounting in force exchange relationship with said skewback refractory means and having another arm on the other side of said pivotal mounting, and h. means for interconnecting said another arm of said coupling means with a fixed point that is independent of said furnace and said support columns.

9. The invention as in claim 8 wherein said pivotal mounting means for said coupling means comprise first bearing members fastened to said coupling means and second bearing members fixed to said support columns, respectively, said first and second bearing members having complementary surfaces in bearing relation with each other.

10. The invention as in claim 8 wherein said pivotal mounting means for said coupling means comprise elongated convex bearing members fastened to said coupling means and elongated concave bearing members fixed to said support columns, said convex members being in bearing relation with said concave members.

11. The invention as in claim 8 wherein said pivotal mounting means for said coupling means comprise first bearing members having a cylindrical surface the axes of which are disposed longitudinally of said furnace, said first members being fixed on said coupling means, and second bearing members having a cylindrical surface the axes of which are in substantial parallelism with the aforesaid axes, said second bearing members being fixed on said support columns, said cylindrical surfaces of said first and second bearing members, respectively, being complementary to each other and in mutual bearing relationship.

12. The invention as in claim 8 wherein said means for interconnecting said another arm comprise elongated rod means and means for pivotally connecting said rod means to said another arm of said coupling means, and means for adjusting the length of said rod means.

13. The invention as in claim 8 wherein said means for connecting said another arm comprise elongated rod means having means at one end for pivotally connecting with said another arm of said coupling means and means at an opposed end for pivotally connecting to said fixed point.

14. The invention as in claim 8 wherein said means for interconnecting said another arm of said coupling means comprise elongated rod means having means at one end for pivotally connecting with said another arm of said coupling means and having means at its opposed end for pivotally connecting with said support column which provides said fixed point.

15. The invention as in claim 14 including turnbuckle means interposed in said rod means for permitting establishing the angular attitude of said another arm.

16. The invention as in claim 8 wherein:

a. said pivotal mounting means for said coupling means comprise first bearing members having cylindrical surfaces, respectively, the axes of which are disposed longitudinally of said furnace, said first bearing members being fixed on said another arm and second bearing members having cylindrical surfaces, respectively, the axes of which are in substantial parallelism with the aforesaid axes, said second bearing members being fixed on said support column, said cylindrical surfaces of said bearing members, respectively, being complementary to each other and in mutual bearing relationship.

b. said interconnecting means comprising elongated means and means for pivotally connecting said elongated means at one end to said another arm of said coupling means and means for pivotally connecting an opposed end of said elongated means to said support column supporting means which provides said fixed point.

17. The invention set forth in claim 16 and including electrode means extending through said roof for heating a quantity of molten metal in said furnace.

18. An electric arc furnace comprising:

a refractory lined furnace body defining a side wall and a hearth and having a top opening, means for supporting said furnace body, a plurality of skewback refractory means disposed along the top of said wall, said skewback means having beveled surfaces, an arched refractory roof engaging said beveled surfaces to support said roof, a plurality of longitudinally spaced apart support means adjacent said furnace body, coupling means engaging said skewback means and pivotal means for mounting said coupling means for pivotal movement relative to said support means, said coupling means having a first portion on one side of said pivotal means in force exchange relationship with said skewback means and having another portion on the other side of said pivotal means, and means for interconnecting said another portion of said coupling means with a fixed point that is independent of said furnace and said support means.

19. The invention as in claim 18 wherein said pivotal means comprise first bearing members fastened to said coupling means and second bearing members fixed to said support columns, respectively, said first and second bearing members having complementary surfaces in bearing relation with each other.

20. The invention as in claim 18 wherein said pivotal mounting means for said coupling means comprise first bearing members having a cylindrical surface the axes of which are disposed longitudinally of said furnace, said first member being fixed on said coupling means, and second bearing members having a cylindrical surface the axes of which are in substantial parallelism with the aforesaid axes, said second bearing members being fixed on said support columns, said cylindrical surfaces of said first and second bearing members, respectively, being complementary to each other and in mutual bearing relationship.

* * * * *